United States Patent [19]

Knobbe

[11] Patent Number: 4,990,359

[45] Date of Patent: Feb. 5, 1991

[54] ELECTROSTATIC METHOD FOR COATING REDISTRIBUTION

[75] Inventor: Alan J. Knobbe, Lorain, Ohio

[73] Assignee: Nordson Corporation

[21] Appl. No.: 435,570

[22] Filed: Nov. 13, 1989

[51] Int. Cl.[5] ..... B05D 1/04

[52] U.S. Cl. ..... 427/32; 427/13; 427/120

[58] Field of Search ..... 427/14.1, 26, 27, 32, 427/13, 120; 118/624, 638

[56] References Cited

U.S. PATENT DOCUMENTS

| | | | |
|---|---|---|---|
| 2,428,991 | 10/1947 | Ransburg | 118/635 |
| 2,636,471 | 4/1953 | Starkey | 118/624 |
| 3,401,058 | 9/1968 | Lockie et al. | 427/13 |
| 4,084,019 | 4/1978 | Christ et al. | 427/32 |
| 4,169,903 | 10/1979 | Scholes | 427/28 |
| 4,343,828 | 8/1982 | Smead et al. | 427/27 |
| 4,436,763 | 3/1984 | Metz | 427/47 |
| 4,472,452 | 9/1984 | Gillette et al. | 427/32 |
| 4,513,683 | 4/1985 | Kisler | 118/638 X |
| 4,514,435 | 4/1985 | Shannon et al. | 427/8 |
| 4,606,928 | 8/1986 | Dunford et al. | 427/32 |

*Primary Examiner*—Evan Lawrence

*Attorney, Agent, or Firm*—Wood, Herron & Evans

[57] ABSTRACT

A method for rendering uniform a coating applied to a substate is provided which redistributes a flowable non-uniformly applied coating with electrostatic forces after the coating has been deposited and before it solidifies. An electrostatic charging station charges the coating which, in the illustrated embodiment, is an insulative dip coating on a running length of rectangular conductive wire, as the wire emerges from a coating tank. The charged coating is passed to a coating redistribution station where shaped charged electrodes positioned to coincide with geometric high or low prints on the wire surface attract or repel coating material to cause it to flow from the more thickly to the more thinly coated regions. The redistributed coating is then dried at a drier station.

12 Claims, 2 Drawing Sheets

ELECTROSTATIC METHOD FOR COATING REDISTRIBUTION

FIELD OF THE INVENTION

The present invention relates to the application of coatings to substrates and more particularly to a method and apparatus for redistributing a coating applied to the substrate subsequent to its application to the substrate to render the coating more uniform.

BACKGROUND OF THE INVENTION

The uniformity of the coatings applied to manufactured objects and other substrates by various coating processes has been a long sought objective of the coating processes of the prior art. Various types of coating processes apply coating materials in ways which do not initially result in the desired uniformity of the thickness of the coating across the substrate. In many circumstances, the lack of desired uniformity is at least partially due to the shape of the object being coated. In electrostatic coating processes, for example, objects having corners, raised portions with short radii, or other projecting portions cause a concentration of the electrostatic field at such portions and this concentration causes a non-uniform deposition of the charged coating material. This results in a greater applied coating thickness at the more highly charged raised areas than is distributed by the electrostatic coating process elsewhere on the coated substrate. If allowed to solidify in its non-uniform state, the applied coating retains an irregular thickness. With most coating processes of the prior art, the irregular thickness of coating is tolerated and more than the ideal amount of coating material is applied to compensate for, and adequately cover, the more thinly coated regions.

The problem of non-uniform application of coating materials is not unique to electrostatic coating processes. In dip-coating processes, for example, the effect which substrate shape has on non-uniformities in the thickness of applied coatings is often even more of a problem than with electrostatic coating processes. The non-uniform thickness thus caused usually correlates with the characteristic contours of the object surface, tending to coat quite thinly at corners and raised areas of the substrate surface.

A serious problem is found to occur in applying coatings to running lengths of wire by dipping the wire into the coating material. In such applications, it is often the objective to apply an insulative coating to the wire. To insulate efficiently, the coating must achieve a minimum thickness everywhere across the surface. Excess coating at any point provides no advantage. The wire, if of a non-round cross-section, such as rectangular wire, has surface non-uniformities such as corners, ridges, or regions with short radii which will collect coating which is thinner in the regions of the corners of the wire, or in regions of shorter radii, than it is at the smoother or flat sides between the corners. The tendency of the flowable liquid dip coating material to thin out at the raised corners of the object is a common occurrence with dip coating processes. The non-uniform thickness of coatings so applied is usually attributed to the effect of the surface tension of the liquid coating. If allowed to solidify in the non-uniform condition, which most prior art processes cannot avoid, an inferior irregular thickness of the coating results. To prevent some regions from having a coating which is too thin, more coating than necessary is used to coat the flatter regions of the substrate surface so that an adequate minimum thickness is assured at the corners.

While various efforts have been made to control the deposition rate of coating material differently onto different regions of the object or substrate during application of the coating, the processes have been complex and expensive, and their results have at least partially been unsatisfactory. Objects nonetheless continue to be coated in the various commercial processes, such as the examples described above, with coatings which are not uniform particularly where substrate geometry which presents corners or other non-uniform surface curvature is involved.

SUMMARY OF THE INVENTION

It is a primary objective of the present invention to provide a method and apparatus by which coating material which has been applied with non-uniform thickness to a substrate may be satisfactorily redistributed on the substrate surface to render the coating more uniform, and to do so particularly while the coating is still flowable and before it solidifies on the substrate.

According to the principles of the present invention, substrate objects which have been coated with a coating material and which is distributed across the substrate surface with a thickness which is not uniform are subjected to a post-deposition application of electrostatic force to redistribute the coating on the substrate. Where such non-uniformity in coating thickness is due to substrate surface geometry of non-uniform curvature, the post deposition process applies the electrostatic force in accordance with the substrate geometry. In the preferred embodiment of the present invention, the non-uniformly applied coating is redistributed by the application of electrostatic force to move the deposited and still flowable coating so as to urge the coating to flow on the surface from the thicker to the more thinly coated areas. In this manner, the irregularly deposited coating is rendered more uniform.

The post deposition process for redistributing the coating is accomplished with the present invention by electrostatically charging and then attracting or repelling the deposited coating to redistribute it on the substrate surface. With the present invention, the electrostatic forces which cause the redistribution of the coating may be, and preferably are, related to the geometry of the object. This was in part at least responsible for the non-uniformity of the coating. Thus, the forces which accomplish the corrective flow can be made to offset the initial non-uniformity in thickness by configuration of the forces to correspond in both polarity and magnitude to the non-uniformities in geometry.

According to the preferred embodiment of the present invention, the liquid or flowable coating which has been deposited onto the object is, prior to the solidification of the coating, imparted with an electrostatic charge. This charge is preferably a negative charge and preferably applied with a corona discharge method. Once the coating is charged, the coated object is passed to a station at which the different portions of the substrate surface, as for example the raised corners of a rectangular dip coated wire, and brought into proximity with electrostatically charged electrodes shaped and configured to interact with the charged coating selectively at the different regions on the substrate which correspond to the geometric features which correlate with the thickness variations to be corrected.

For example, in the case of the dip coated rectangular wire, the electrodes are selectively positioned adjacent the raised corners of the dip coated wire and are charged opposite to the charge imparted to the flowable insulative coating on the substrate, to attract and thereby force the non-solidified coating to flow toward the thinly coated corners and thereby to cause the overall coating to become more uniform. Particularly, in the case of dip coated wire of rectangular cross section which will have a tendency, when dip coated, to emerge from a coating tank with a thinner coating at its corners, the electrodes positioned proximate to the wire corners will be charged to the opposite charge as that imparted to the coating so as to attract coating from the thicker coating region between the corners toward the more thinly coated corners, causing the coating to flow and become more uniform in thickness before it solidifies.

Similarly, where a liquid or other flowable coating is electrostatically applied to a coated object it will often have a tendency to attract a thicker coating at its raised portions. In such an application of the principles of the present invention, electrodes are positioned adjacent the raised portions and imparted with a charge which is the same as that charge imparted to the coating. The forces so generated will thus repel the coating from the more thickly coated areas at the raised regions, thus causing it to flow toward the more thinly coated flat regions so as to render the coating more uniform across the substrate.

According to principles of the present invention, an object coated with a method which is a simple straightforward coating method, but which has a tendency to apply a non-uniform coating to substrates because of the geometry of the substrate surface, can be subsequently processed so as to cause the coating to be redistributed and rendered more uniform in thickness. This coating distribution is achieved by charging the coating which has been applied to the substrate and then passing the object, while the coating is still flowable, through a coating redistribution station immediately following the coating process and prior to the solidification of the coating.

These and other objectives and advantages of the present invention will be more readily apparent from the following detailed description of the drawings in which.

Figure 1:
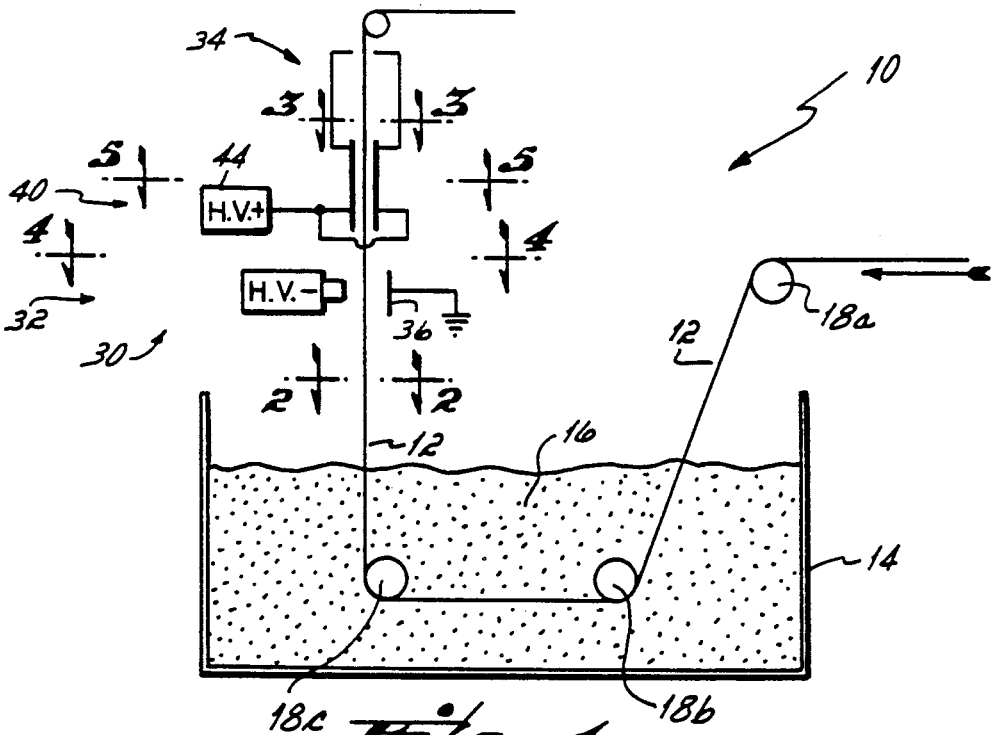
FIG. 1 is a schematic diagram illustrating a dip coating process for rectangular cross-section wire which embodies the principles of the present invention.

Referring to FIG. 1, a dip coating system 10 for applying a coating to a running length of wire 12 is shown. In the system 10, a dip tank 14 containing a powder slurry of coating material 16 is diagrammatically illustrated. The wire 12 is electrically conductive. The coating material 16 is generally a material which forms a high resistance coating when deposited upon the wire to provide electrical insulation. However, other coatings applied for other purposes onto other types of substrates may be redistributed according to the present invention.

Figure 2:
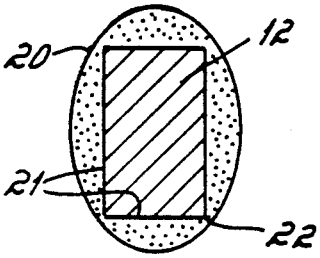
FIG. 2 is a cross-sectional view along line 2—2 of FIG. 1 showing the irregular distribution of flowable coating on the wire as it emerges from the coating station in the process of FIG. 1.

In the dip coating process performed with the system 10, a continuous length of the wire 12 is longitudinally advanced, usually guided by rollers represented schematically in the drawing as 18*a*, 18*b* and 18*c*, is fed longitudinally through the coating material 16 to emerge therefrom having a moderately flowable non-solidified coating 20 thereon as illustrated in FIG. 2. As will be seen in FIG. 2, the coating 20 is of non-uniform thickness about the surface of the wire 12. This phenomenon is generally regarded as due to the surface tension of the liquid coating which gives the coating a tendency to assume a generally round cross-section even though the substrate or wire 12 on which the coating material 20 is applied is not of round cross-section.

The wire 12 in the application shown in the figures is of rectangular cross-section having flat sides 21 separated by right angle corners 22. As is typical in a coating process of the dip coating type, the coating material 20 will encircle the cross-section of the wire 12 to develop a minimum surface area. This tends to produce a coating distribution which is thickest at regions central to the sides 21 and thinnest in regions adjacent the outside corners 22 of the wire 12.

Figure 3:
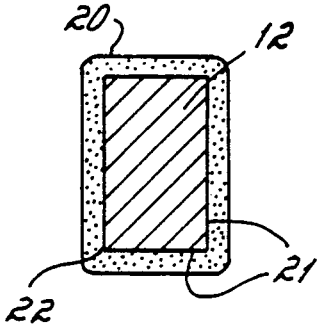
FIG. 3 is a drawing similar to FIG. 2 taken along line 3—3 of FIG. 1 showing the distribution of coating on a rectangular wire after being subjected to the coating redistribution steps according to principles of the present invention.

The preferred and ideal coating, on the other hand, is such as that illustrated in FIG. 3 wherein the coating 20 is shown distributed in accordance with the present invention such that the thickness is approximately the same in the vicinity of the corner regions 22 of the wire 12 as it is adjacent the flat sides 21 of the wire 12. The uniformity of the coating shown in FIG. 3 is the result of the inventive concepts set forth in connection with the description of FIGS. 1, 4 and 5.

Figure 4:
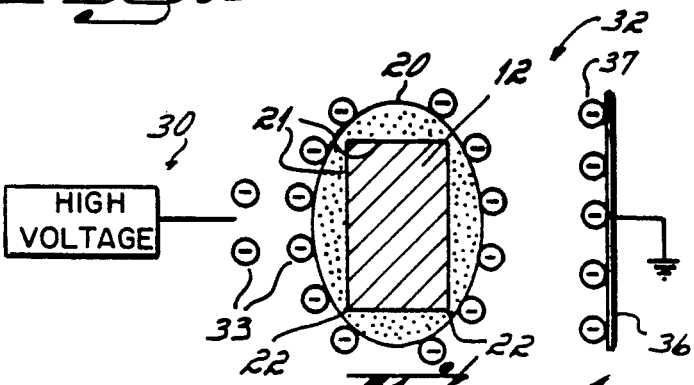
FIG. 4 is a schematic cross-sectional view and diagram showing a charging station of the process of FIG. 1 in accordance with the principles of the present invention.

Referring to FIGS. 1 and 4, immediately after emerging from the dip tank 14, the coating 20 on the wire 12 is still non-solidified and flowable. At this point, high voltage is applied through a corona discharge device 30 positioned adjacent the wire 12 at a charging station 32 to impart a negative electrostatic charge 33 to the coating 20 on the wire 12 as the wire 12 advances longitudinally from the tank 14 toward a dryer station 34 downstream. Adjacent the station 32 is a grounded plate 36 to collect the charge 37 which is excessively produced by the device 30 and fails to collect upon the coating 20 of the wire 12 at the station 32. Preferably, the wire 12 and the tank 14 and coating 16 thereon are also maintained at ground potential so that the wire 12 with the coating 20 thereon emerges from the tank 14 at ground potential and will thus attract the charge 33. The coating 20 which is usually of insulative material will hold the charge 33 on its outer surfaces.

Figure 5:
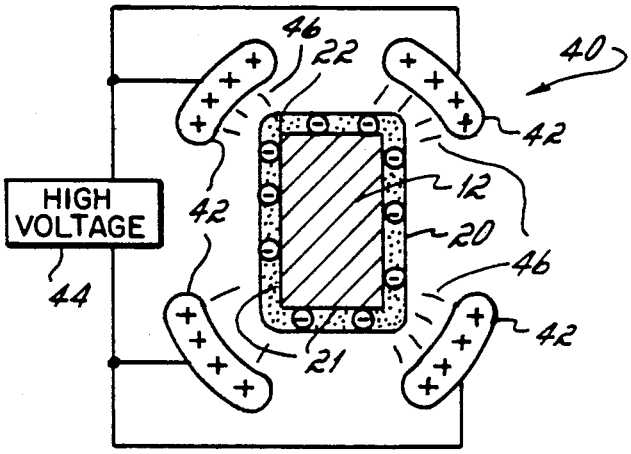
FIG. 5 is a partially schematic diagram in cross-sectional view illustrating an electrostatic coating redistribution station portion of the system of FIG. 1.

As the wire 12 continues to advance through the charging station 32 and emerges with its coating 20 charged to negative potential, the wire 12 passes through a coating redistribution station 40 illustrated by reference to FIGS. 1 and 5. Referring to FIG. 5, at the coating redistribution station 40 is provided a plurality of shaped electrodes 42 positioned adjacent the path of the wire 12 so as to be in closest proximity to the coating 20 at the corners 22 of the wire 12. Connected to the electrodes 42 is a source of high voltage dc energy designed to impart a high voltage positive electric potential, of for example 90 thousand volts, on the electrodes 42. As seen by reference to FIG. 5, these electrodes 42, so charged and so positioned with respect to the surface geometry of the wire 12, generate electrostatic attracting forces represented by field lines 46 which attract the negatively charged coating 20 and draw it toward the corners 22 of the wire 12 from adjacent the flat sides 21 where the coating 20 is more thickly deposited. As such, the wire 12 emerges from the coating redistribution station 40 with the coating 20 redistributed approximately as shown in FIG. 3. Before the coated wire leaves the influence of the electrostatic field 46 of the coating redistribution station 40, the coating is passed into the dryer station 34 where the non-solidified and still flowable coating 20 solidifies in the condition shown in FIG. 3, thus uniformly coating the wire 12.

Figure 6:
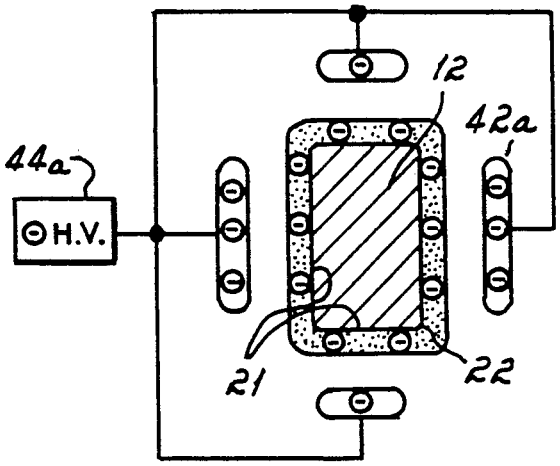
FIG. 6 is a diagram similar to FIG. 5 illustrating an alternative embodiment of the invention.

It will be appreciated from the teachings set forth above that, while attractive forces are used at the redistributing station 40 to redistribute the charged flowable coating 20 on the wire 12, differently positioned electrodes 42 oppositely charged to have the same charge as the coating 20 could effectively repel coating material and thereby redistribute the coating 20. Such an arrangement is illustrated, for example, in FIG. 6 wherein the power supply 44*a* imposes a negative charge on electrodes 42*a* to repel the thick portions of the coating adjacent the flat sides 21 of the wire 12 to the corners 22. With coating processes such as electrostatic spray coating processes which have a tendency to deposit thicker coatings at the raised regions, the electrode configuration of FIG. 5 can similarly be used to repel the coating from the corners 22 toward the flat sides 21 of the wire 20. Because it may in many applications be easier to conform the external electrodes 42 to exert properly shaped fields adjacent raised regions of the object rather than to employ electrodes such as 42*a* (FIG. 6) adjacent the lowered regions on the surface of the substrate, in such applications repulsive forces instead of attraction forces will often be more desirable.

Having described the invention, the following is claimed:

1. A method for enhancing the uniformity of a coating on a substrate wherein the coating has been deposited in a non-uniform thickness across a substrate and has a non-solidified flowable state following its deposition onto the substrate and before its solidification thereon, the method comprising the steps of:

electrostatically charging the non-solidified coating deposited on the substrate; and then placing the substrate in relative proximity to at least one charged electrode shaped to selectively exert electrostatic force differently to different portions of the coating to electrostatically redistribute the coating on the substrate.

2. The method of claim 1 further comprising the step of imparting an electrostatic charge to the electrodes opposite to that imparted to the coating before placing said substrate in relative proximity to the electrode.

3. The method of claim 2 wherein the charging step comprises the step of imparting a negative electrostatic charge to the substrate.

4. The method of claim 1 wherein said charging step comprises the step of imparting a negative electrostatic charge to the substrate.

5. The method of claim 1 wherein said charging step comprises the step of subjecting said deposited coating to a corona discharge.

6. The method of claim 1 wherein said coating is a powder slurry.

7. The method of claim 1 further comprising the step of solidifying said coating after electrostatically redistributing the coating on the substrate.

8. The method of claim 7 wherein said placing step includes the step of maintaining the electrostatic force until the coating is solidified on the substrate.

9. The method of claim 1 wherein the substrate is an object having corners and wherein said placing step includes the step of placing a plurality of electrodes adjacent the corners and charged opposite to the coating material so as to attract the deposited coating material from regions between the corners of the object, where it has a greater thickness, to redistribute it toward the regions at corners of the object, where it has a lesser thickness.

10. The method of claim 9 wherein the object is a continuous wire of rectangular cross-section onto which the coating material has been deposited by dipping the wire therein by running the wire longitudinally through the coating material, and wherein said electrodes include four electrodes placed adjacent the corners of the wire emerging from the coating application tank and is charged opposite to the charge imparted to the coating.

11. The method of claim 1 wherein said electrodes are placed proximate less thickly coated regions of the substrate and said method further comprises the step of imparting an electrostatic charge to the electrodes opposite to that imparted to the coating before placing said substrate in relative proximity to the electrodes.

12. The method of claim 1 wherein said electrodes are placed proximate more thickly coated regions of the substrate and said method further comprises the step of imparting an electrostatic charge to the electrodes of the same polarity as that imparted to the coating before placing said substrate in relative proximity to the electrodes.

* * * * *